US010260800B2

(12) United States Patent
Baysal et al.

(10) Patent No.: US 10,260,800 B2
(45) Date of Patent: Apr. 16, 2019

(54) MIXED BEVERAGE PRODUCTION APPLIANCE, DOMESTIC REFRIGERATION APPLIANCE CONTAINING SUCH A MIXED BEVERAGE PRODUCTION APPLIANCE AND METHOD FOR PREPARING A MIXED BEVERAGE

(71) Applicant: BSH HAUSGERAETE GMBH, Munich (DE)

(72) Inventors: Kudret Baysal, Giengen Brenz (DE); Carsten Weiss, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 102 days.

(21) Appl. No.: 15/432,963

(22) Filed: Feb. 15, 2017

(65) Prior Publication Data

US 2017/0241703 A1 Aug. 24, 2017

(30) Foreign Application Priority Data

Feb. 22, 2016 (DE) ..... 10 2016 202 679

(51) Int. Cl.

| | |
|---|---|
| ***B67D 1/00*** | (2006.01) |
| ***F25D 31/00*** | (2006.01) |
| ***B67D 1/08*** | (2006.01) |
| ***F25B 41/06*** | (2006.01) |
| ***F25D 11/02*** | (2006.01) |
| ***F25D 23/12*** | (2006.01) |

(Continued)

(52) U.S. Cl.

CPC ..... *F25D 31/002* (2013.01); *B67D 1/0021* (2013.01); *B67D 1/0857* (2013.01); *B67D 1/0861* (2013.01); *F25B 5/02* (2013.01); *F25B 41/062* (2013.01); *F25B 49/02* (2013.01); *F25D 11/022* (2013.01); *F25D 23/126* (2013.01); *F25B 2341/0661* (2013.01); *F25B 2600/2513* (2013.01); *F25B 2700/21175* (2013.01); *F25D 2700/121* (2013.01)

(58) Field of Classification Search

CPC .... F25D 31/002; F25D 11/022; F25D 23/126; B67D 1/0857; B67D 1/0021; F25B 5/02; F25B 2700/21175

See application file for complete search history.

(56) References Cited

U.S. PATENT DOCUMENTS

| | | | | |
|---|---|---|---|---|
| 3,323,681 | A * | 6/1967 | Di Vette | B67D 1/0021 222/129.1 |
| 2009/0199586 | A1 | 8/2009 | Soysal et al. | |
| 2012/0104024 | A1 * | 5/2012 | Anselmino | F25D 23/126 222/1 |

FOREIGN PATENT DOCUMENTS

| | | | |
|---|---|---|---|
| DE | 19615106 | A1 | 8/1997 |
| WO | 2007141321 | A2 | 12/2007 |

* cited by examiner

*Primary Examiner* — Ana M Vazquez

(74) *Attorney, Agent, or Firm* — Laurence A. Greenberg; Werner H. Stemer; Ralph E. Locher

(57) ABSTRACT

A mixed beverage production appliance has a first container which is configured for receiving a first fluid having a first freezing point and is able to be added to a mixed beverage and a second container which is separate therefrom and which is configured for receiving a second fluid having a second freezing point which is different from the first freezing point and which is able to be added to a mixed beverage. The two containers are connected into a refrigerating circuit of the mixed beverage production appliance which is configured such that the two containers are able to be subjected to different temperatures independently of one another.

18 Claims, 2 Drawing Sheets

(51) Int. Cl.
*F25B 5/02* (2006.01)
*F25B 49/02* (2006.01)

MIXED BEVERAGE PRODUCTION APPLIANCE, DOMESTIC REFRIGERATION APPLIANCE CONTAINING SUCH A MIXED BEVERAGE PRODUCTION APPLIANCE AND METHOD FOR PREPARING A MIXED BEVERAGE

CROSS-REFERENCE TO RELATED APPLICATION

This application claims the priority, under 35 U.S.C. § 119, of German application DE 10 2016 202 679.8, filed Feb. 22, 2016 the prior application is herewith incorporated by reference in its entirety.

BACKGROUND OF THE INVENTION

Field of the Invention

The invention relates to a mixed beverage production appliance having a first container which is configured for receiving a first fluid having a first freezing point. The mixed beverage production appliance also has a second container for receiving a second fluid having a second freezing point which is different from the first freezing point. The invention further relates to a domestic refrigeration appliance having such a mixed beverage production appliance and a method for producing such a mixed beverage.

A method and a device for the continuous production of soda water or soda-like water is disclosed in published, non-prosecuted German patent application DE 196 15 106 A1. A device is disclosed therein where different fluids such as lemonade, beer or wine may be present in different separate containers. Each container is connected to a separate dispensing tap and is thus separated from the other container. It is not possible to produce and dispense a mixed beverage consisting of different fluids in the containers in the interior of the unit itself. The dispensing taps are also spaced far apart so that it is not possible to introduce fluids from different dispensing taps into a drinking vessel simultaneously.

A domestic refrigeration appliance is disclosed in international patent disclosure WO 2007/141321 A2, corresponding to U.S. patent publication No. 2009/0199586, which is configured as a beverage appliance for dispensing a beverage on the domestic refrigeration appliance itself.

Automatic cold beverage dispensers are also known, in which alcoholic mixed beverages, for example cocktails, may be dispensed.

In such mixed beverage production appliances the temperature control is an essential factor for producing cooled mixed beverages.

SUMMARY OF THE INVENTION

It is the object of the present invention to provide a mixed beverage production appliance as well as a domestic refrigeration appliance and also a method for producing a mixed beverage by which the preparation of cooled mixed beverages is improved.

This object is achieved by a mixed beverage production appliance, a domestic refrigeration appliance and a method as claimed in the independent claims.

A mixed beverage production appliance has a first container which is configured, in particular, for receiving a first fluid having a first freezing point. The mixed beverage production appliance also has at least one second container which is separate therefrom and which, in particular, is configured for receiving a second fluid having a second freezing point which is different from the first freezing point.

It is provided, in particular, that the at least two containers are connected into a refrigerating circuit of the mixed beverage production appliance and/or are integrated by being thermally coupled therein. This refrigerating circuit is configured such that the two containers are independent of one another and thus are able to be subjected to different temperatures without influencing one another thermally. In a very advantageous manner by means of this embodiment, the individual cooling of the respective containers is possible so that the individual fluids which are able to be introduced are able to be kept at different temperature levels. This has substantial advantages relative to the storage of the individual fluids. Moreover, by this embodiment it is also achieved that the fluids are prevented from freezing, therefore, since it is even possible to cool a container at a temperature at which the fluid which is able to be introduced into the other container would have already been frozen at its individual freezing point. To this end, in this connection it is possible that such a container in which fluids having a very low freezing point, in particular having a freezing point significantly lower than 0° C., are able to be stored, may be subjected to a temperature which is also lower than 0° C. and the freezing of this fluid which is able to be stored therein is still prevented. At the same time, therefore, it is also avoided that subjecting this container to such low temperatures has no effect on the other container where the fluid having a higher freezing point relative thereto is stored.

Moreover, by means of this embodiment of the invention it is also achieved that a mixed beverage is able to be produced, in which a desired cooled mixed beverage is dispensed by the individual temperature control of the fluids, the dispensed mixed beverage then having a mixed temperature which permits the consumption or the enjoyment of this mixed beverage to be adapted in a particularly advantageous manner.

Thus in these embodiments it is possible to avoid the necessity of too many cooling elements, for example ice cubes, being extensively added subsequently into the already dispensed mixed beverage in order to achieve a desired consumption temperature of the mixed beverage.

Preferably, it is provided that the mixing of fluids is able to be carried out in the mixed beverage production appliance itself. Thus a dispensing unit and thus an outlet is configured as a single-channel outlet. As a result, a plurality of outlets does not have to be actuated and/or activated in order to permit the mixing outside the appliance in the drinking vessel itself. As a result, a smaller appliance with variable operation is possible. If separate outlets are configured for each fluid, these outlets are arranged adjacent to one another, such that the fluids flowing out of the outlets are able to flow simultaneously into a drinking vessel positioned thereunder, so that the drinking vessel does not have to be shifted in position in order to be able to receive the fluids and/or so that the fluids do not necessarily have to be discharged merely one after the other.

Preferably, it is provided that the refrigerating circuit is configured such that the temperature of the first container is between 0.8° C. and 8° C., in particular between 0.8° C. and 1.5° C. In particular, it is thus provided that the temperature of the first container is set so that in the case where the first fluid is also located in the container, this first fluid has a temperature of between 0.8° C. and 2° C., in particular of between 0.9° C. and 1.4° C. Thus when this first fluid is water, it is possible to carry out maximum cooling according to requirements without this water being frozen.

Preferably, it is provided that the refrigerating circuit is configured such that the temperature of the second container is between −8° C. and −20° C., in particular between −13° C. and −17° C. In particular, it is provided that the temperature of this second container in these subzero temperatures is controlled such that, in the case of the state of the second fluid introduced into this second container, this second fluid has a temperature of between −8° C. and −20° C., in particular of between −13° C. and −17° C., and nevertheless this second fluid does not freeze.

Preferably, the second fluid is alcohol or an alcoholic fluid.

In these specific embodiments, therefore, even an alcoholic mixed beverage may be produced and dispensed according to requirements by the mixed beverage production appliance.

In one advantageous embodiment, it is provided that the refrigerating circuit has a first partial circuit, the first container being connected and/or thermally coupled therein. In particular, the refrigerating circuit has a second partial circuit connected in parallel thereto, the second container being connected and/or thermally coupled therein. By such a parallel connection of partial circuits of the refrigerating circuit, the aforementioned individual temperature control of the containers and thus also the independent temperature control thereof from one another is achieved in a particularly advantageous manner. The temperature control may take place in this connection in a very accurate and particularly rapid manner, whereby energy-efficient cooling also takes place.

Advantageously, it is provided that a first evaporator is connected into the first partial circuit. This first evaporator is preferably directly connected to the first container and/or thermally coupled thereto. In one advantageous embodiment, it may be provided that the first container is at least partially encompassed by the first evaporator.

This means in one embodiment that when a container is of cylindrical configuration, the evaporator is integrally formed, at least in the manner of a half-shell, on the outer wall of the cylinder and, in particular, bears directly thereagainst. It may also be provided that the evaporator is configured to be tubular and fully encloses the container, which is specifically shaped relative thereto, over the circumference of its outer wall.

Moreover, when the geometry of the container is shaped as a half-shell or tapers in a rotationally symmetrical manner, an evaporator which correspondingly tapers and/or narrows in the axial direction and thus in the longitudinal direction of the container is configured, for example. In this connection, however, further different geometries of the container may also be provided, in particular the shape of the evaporator thus being adapted thereto. By means of such an embodiment, therefore, a maximum connection and thus coupling of the evaporator to the container is achieved so that the cooling action and the rapid cooling is achieved in a particularly advantageous manner.

In a particularly advantageous manner by means of this embodiment, in particular by means of the partial circuits and in particular the respective evaporators in the partial circuits, a particularly rapid cooling is achieved when refilling a first fluid into the first container and/or when refilling a second fluid into the second container, when the respective temperatures of the refilled fluids are higher than the temperatures of the respective fluids which are still in the respective containers. Such a heating of the fluids present in the containers caused by the refilling is then compensated by these advantageous embodiments of the refrigerating circuits in a very rapid and accurate manner, so that in turn the desired and preferably aforementioned temperature ranges, which are very cool, may then be achieved.

In particular, it is provided that a first valve, in particular a thermally-controlled expansion valve, is connected into the first partial circuit upstream of the first evaporator in the direction of flow of a refrigerant in the first partial circuit.

In a further advantageous embodiment, it is provided that a temperature detection unit is arranged adjacent to the first evaporator, in particular at an outlet of the first evaporator viewed in the direction of flow of the refrigerant in the first partial circuit, a temperature being able to be detected thereby and the thermally-controlled expansion valve being able to be operated dependent thereon. A particular advantage of such thermally-controlled expansion valves is to permit an accurate temperature control of the evaporator. Moreover, such a thermally-controlled expansion valve of this evaporator may be closed in a partial circuit which is not operated for a specific situation and thus is then able to be used as a stop valve.

In particular, it is provided that a second valve is connected into the first partial circuit downstream of the first evaporator in the direction of flow of a refrigerant in the first partial circuit. This second valve may, in particular, also be a stop valve. It may, however, also be a non-return valve.

In a further advantageous embodiment, it is provided that a second evaporator is connected into the second partial circuit. This second evaporator is connected and/or thermally coupled, in particular, to the second container. In particular, the second evaporator at least partially encompasses the second container. Corresponding advantageous embodiments may, in particular, be those as have been cited as advantageous embodiments when the first container is encompassed by the first evaporator.

Advantageously it is provided that a second valve, in particular a thermally-controlled expansion valve, is connected into the second partial circuit upstream of the second evaporator in the direction of flow of a refrigerant in the second partial circuit. The corresponding advantages as have already been cited by the preferably thermally-controlled expansion valve in the first partial circuit may also be achieved in this case.

In particular, it is also provided that a temperature detection unit is arranged adjacent to the second evaporator, in particular at an outlet of the second evaporator viewed in the direction of flow of the refrigerant in the second partial circuit, a temperature being able to be detected thereby and the thermally-controlled expansion valve being able to be operated dependent thereon. Pressure control is also encompassed thereby.

In particular, it is provided that a second valve is connected into the second partial circuit downstream of the second evaporator in the direction of flow of a refrigerant in the second partial circuit. This second valve may also be a stop valve or a non-return valve.

Advantageously, by means of the parallel connection of the evaporator-partial circuits of the refrigerating circuit, it is achieved that the evaporators present in the partial circuits are located at different pressure levels, whereby the different temperatures for the containers may be set independently of one another. Even when different freezing points of the fluids are present and the fluids are located in the containers, by means of this embodiment with temperatures which are able to be set independently of one another, the fluid which has a higher freezing point is also prevented from freezing.

Moreover, the refrigerating performance of a condenser of the refrigerating circuit is no longer reduced when the container, in which the fluid is introduced at the higher freezing point, is cooled.

It is also possible to prevent refrigerant in the shut-off evaporators from being displaced, so that an evaporator is not able to be underfilled during operation. As a result, it is also achieved that the refrigerating performance of an evaporator is not undesirably reduced and a heterogeneous temperature layering in the containers may also be avoided.

Thus it is also achieved that an evaporator is able to be prevented from being overfilled during operation, the overfilling being operating point-dependent. This overfilling is prevented, in particular, by the refrigerating performance of the compressor not being reduced and thus pulsed operation with the resulting acoustic drawbacks also being able to be avoided.

In the evaporator which is provided for cooling the container into which the fluid at the higher freezing point is intended to be introduced, a higher evaporation temperature then may be set and thus a greater refrigerating performance achieved, wherein at the same time the formation of ice in this container and the freezing of the fluid introduced therein is nevertheless avoided.

Moreover, it is provided in one advantageous embodiment that the first container has at least one active intermixing element for actively intermixing the first fluid. Additionally or alternatively, it may also be provided that the second container has at least one active intermixing element for actively intermixing the second fluid. An active intermixing may be implemented, for example, by a mixing element according to the invention in a container. For example, a mechanical mixer or a magnetic mixer may be provided in this case. The fluid may also be circulated in the container by means of a pump.

In a further advantageous embodiment, it may be provided additionally or alternatively that the first container has at least one passive intermixing element for passively intermixing the first fluid. Additionally or alternatively, it may be provided that the second container has at least one passive intermixing element for passively intermixing the second fluid. Examples of the passive intermixing elements may be specific structures of an inner face of a container. Also a vortex generator for targeted guidance of the thermal convection of a fluid in a container may be a passive intermixing element. A passive intermixing may also take place by a refrigerant line which extends into the container. This refrigerant line is a component of the refrigerating circuit in which the refrigerant of the refrigerating circuit thus circulates.

A rapid uniform temperature control of the entire fluid in a container is achieved by means of an intermixing element.

It may also be provided additionally that the mixed beverage production appliance is configured for receiving a capsule containing additives which may be added to the mixed beverage. Additives may be in the form of powder or gel or even liquid. In this connection, the capsule may thus be introduced into a dispensing region of the mixed beverage production appliance and when dispensing the mixed beverage, these contents of the capsule may be dispensed automatically therewith and/or mixed therein or already mixed therein.

In one advantageous embodiment, it is provided that the mixed beverage production appliance is arranged in a receiver space for foodstuffs which is separate, in particular, from the receiving region. This receiving region may be configured in an inner container which defines the receiver space by its walls. However, it may also be provided that the receiving region is configured in a separate inner container from this inner container which defines the receiver space with its walls. These inner containers and/or this inner container are and/or is arranged in the housing.

The receiver space, in particular only the receiver space, is able to be closed on the front face by a door which is pivotably mounted on the housing. In this connection it may be provided that the domestic refrigeration appliance is configured such that only one receiver space is present which, for example, is a refrigeration compartment or a freezer compartment which is able to be closed by a separate door. However, it may also be provided that such a single receiver space is able to be closed by two doors which are leaf doors. It is also possible, however, that with two separate receiver spaces, for example a refrigeration space and a freezer space, each of these receiver spaces is able to be closed by a separate door.

Preferably, on the front face the mixed beverage production appliance is accessible and open and not closed and covered by a door.

In one advantageous embodiment it is provided that the mixed beverage production appliance is arranged in the manner of a drawer in the receiver space and thus is able to be pushed in and pulled out in the depth direction of the domestic refrigeration appliance. As a result, the ease of handling may be simplified for dispensing mixed beverages. A substantial advantage of this embodiment may be seen to be that the accessibility to the housing of the mixed beverage production appliance is facilitated. In particular, the accessibility to the containers and/or other further components in the housing is permitted thereby. It may thus be provided that in the extended state, for example via openings in the side walls which may be closed by flaps, it is possible to reach into the interior of the housing of the mixed beverage production appliance.

The invention further relates to a domestic refrigeration appliance having a housing, a receiver space for foodstuffs being configured therein. The domestic refrigeration appliance also comprises a mixed beverage production appliance according to the invention or an advantageous embodiment thereof. The domestic refrigeration appliance may, for example, be a refrigeration appliance or a freezer appliance or a combined refrigeration-freezer appliance.

The invention further relates to a method for the temperature control of components of a mixed beverage production appliance according to the invention or an advantageous embodiment thereof. In the method, the first container is subjected to a temperature such that a first fluid present in the first container is set to a temperature above its first freezing point. The second container is subjected to a temperature independently of the temperature to which the first container is subjected, such that a second fluid present in the second container is set to a different temperature from the temperature of the first fluid and above its second freezing point.

Advantageous embodiments of the mixed beverage production appliance are also regarded as advantageous embodiments of the method according to the invention. The components of the mixed beverage production appliance in this case are configured to carry out individually or in partial combinations the respective method steps for preparing the mixed beverage.

In particular, the mixed beverage is thus dispensed at a dispenser of the mixed beverage production appliance.

The positions and orientations are specified by the terms "above", "below", "front", "rear", "horizontal", "vertical", "depth direction", "lateral direction", "vertical direction", etc, when the appliance is used as intended and arranged as intended and with an observer standing in front of the appliance and looking in the direction of the appliance.

Further features of the invention are disclosed from the claims, the figures and the description of the figures. The features and combination of features cited above in the description and the following features and combination of features cited hereinafter in the description of the figures and/or shown alone in the figures, are not only able to be used in the respectively specified combination but also in other combinations without departing from the scope of the invention. Thus embodiments, which are not explicitly shown and explained in the figures but which are revealed and able to be produced by separate combinations of features from the described embodiments, are also to be regarded as encompassed and disclosed by the invention. Also, embodiments and combinations of features which thus do not have all of the features of an originally formulated independent claim may be regarded as disclosed. Moreover, embodiments and combinations of features which depart from or deviate from the combinations of features set forth when referring back to the claims may be regarded as disclosed, in particular by the embodiments set forth above.

Other features which are considered as characteristic for the invention are set forth in the appended claims.

Although the invention is illustrated and described herein as embodied in a mixed beverage production appliance, a domestic refrigeration appliance containing such a mixed beverage production appliance and a method for preparing a mixed beverage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
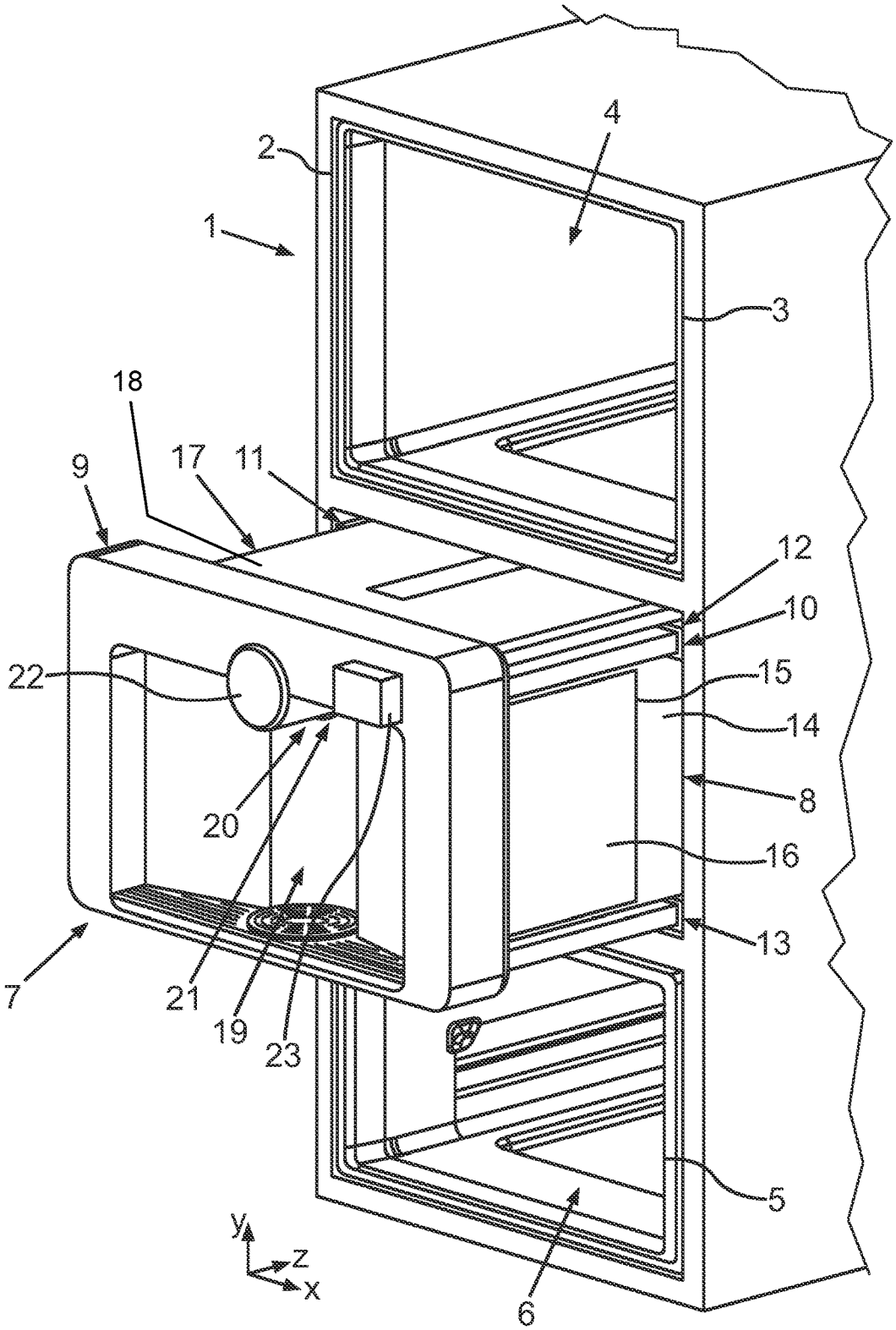
FIG. 1 is a diagrammatic, perspective partial view of an exemplary embodiment of a domestic refrigeration appliance according to the invention.

Elements which are the same or functionally the same are provided with the same reference numerals.

Referring now to the figures of the drawings in detail and first, particularly to FIG. 1 thereof, there is shown a domestic refrigeration appliance 1 is partially shown in a simplified perspective view. The domestic refrigeration appliance 1 in this case is a combined refrigeration-freezer appliance. The domestic refrigeration appliance 1 is configured for storing and preserving foodstuffs. It contains a housing 2, a first inner container 3 being arranged therein. The walls of the inner container 3 define a first receiver space 4 for foodstuffs, wherein the receiver space 4 is a refrigeration compartment.

Moreover, the domestic refrigeration appliance 1 contains a further inner container 5 which with its walls defines a second receiver space 6 which is a freezer compartment. The two receiver spaces 4 and 6 are separated from one another. In the exemplary embodiment shown, the receiver spaces 4 and 6 are arranged in the vertical direction and thus above one another in the vertical direction (y-direction). In the exemplary embodiment, they are preferably able to be closed in each case by separate doors, not shown, which, in particular, are pivotably attached to the housing 2.

Moreover, the domestic refrigeration appliance 1 contains a mixed beverage production appliance 7. The mixed beverage production appliance 7, however, may also be configured as a separate stand-alone appliance and thus may be positioned independently of a domestic refrigeration appliance 1 and may be operated independently thereof. The mixed beverage production appliance 7 is arranged in a receiving region 8 of the housing 2. The receiving region 8 is separate from the receiver spaces 4 and 6. It may be provided that the receiving region 8 is defined by walls of a separate inner container, which is also enclosed in foam in the housing 2. The receiving region 8, however, may also be configured so as to be integrated in the inner container 3 or in the inner container 5.

In the exemplary embodiment, it is provided that the receiving region 8 is arranged in the vertical direction between the receiver space 4 and the receiver space 6.

The mixed beverage production appliance 7 is arranged on the front face and is thus accessible from the front and on the visible side. In particular, it is not able to be closed and thus covered on the front face by a door.

The mixed beverage production appliance 7 has a housing 9.

In the exemplary embodiment it is provided that the housing 9, and thus the entire mixed beverage production appliance 7 in the depth direction and thus in the horizontal direction, which corresponds to the z-direction, is able to be pulled out of the receiving region 8 and is able to be pushed in again in a manner corresponding to a drawer. In FIG. 1 the fully pulled-out state is shown.

Here it is preferably provided that the horizontal displaceability is formed by a displacement device 10 which has a plurality of bearing points. In the exemplary embodiment it is provided that the displacement device 10 contains at least two, in particular four, bearing points. These are formed in the exemplary embodiment as rails which may also be extension rails. In particular, in this case a first rail 11 is arranged in an upper left corner region, a second rail 12 is arranged in the upper right corner region and a third rail 13 is arranged in the lower right corner region and a further rail, not visible in FIG. 1, is arranged in the lower left corner region. A very secure displacement of the housing 9 which is secured in a manner which prevents expansion and tipping over is possible by means of this four-point bearing.

Advantageously, therefore, the mixed beverage production appliance 7 is displaceably mounted in the inner container 8. Advantageously, the displacement device 10 also has an anti-pull-out stop by which the beverage appliance, which is configured in particular as a mixed beverage production appliance 7, is secured in position in a fully extended position shown in FIG. 1. Thus it is not possible to pull out the appliance excessively so that the mixed beverage production appliance 7 is not able to fall forward and/or tip over.

Advantageously, it is also provided that the displacement device 10 has an anti-displacement lock by which the mixed beverage production appliance 7 is arranged so as to be secured from being pulled out when in a position fully pushed into the receiving region 8. The appliance is also prevented thereby from inadvertently slipping out or projecting to the front as a result. An undesirable draining or dripping of a fluid or striking the appliance is thereby prevented. This anti-displacement lock may be a latching device. Additionally or alternatively, however, a magnetic retainer may also be provided, for example.

Advantageously, an access point 15 is configured on a vertical side wall 14 of the housing 9, the access point being closed by a flap 16. After opening the flap 16 it is possible to reach into the inside of the housing 9 so that easy and unrestricted accessibility is permitted for replacement purposes or filling purposes. It may also be provided additionally or alternatively that a corresponding access point is formed on an opposing further vertical side wall 17 and/or at least one such access point 15 is formed on a top wall 18 of the housing 9.

The mixed beverage production appliance 7 also contains a positioning recess 19 on the front face, a drinking vessel being able to be positioned therein, by which the mixed beverage to be produced and dispensed by the mixed beverage production appliance 7 may then be collected. The mixed beverage production appliance 7 contains a dispensing unit 20 with, in particular, a single outlet 21. Preferably, it may be provided that in each case a separate outlet is present for draining each fluid from a container. It may also be provided that additionally an additive in the form of a powder or gel or further liquid may be mixed into this mixed beverage to be produced, the mixed beverage being able to be produced and thus mixed from at least two different fluids. Additionally, in particular, it may be provided that a capsule receiver 22 is configured, a capsule which has the aforementioned additive being able to be introduced therein. During the dispensing of the mixed beverage, this ingredient and/or additive is then removed from the capsule and added to the mixed beverage, in particular before the dispensing into the drinking vessel takes place via the outlet 21.

Moreover, in particular it may be provided that the mixed beverage production appliance 7 has a capsule store 23 and/or a capsule storage area. In the capsule store 23 a capsule or a plurality of capsules may be stored so that they are always present in the immediate vicinity on the appliance itself. In one advantageous embodiment, it may be provided that the capsule store 23 is cooled so that the capsules located therein may also be stored in a correspondingly cooled state.

Preferably, it is provided that the capsule store 23 may be opened by a push-push mechanism, and for example in the form of a displaceable bearing in the form of a rail, and thus the capsules received therein are freely accessible and, for example, may then be easily removed from the top.

Moreover, it may also be provided that the mixed beverage production appliance 7 has a cartridge for mixing carbon dioxide into the mixed beverage. To this end, the accessibility for cartridge replacement is possible via at least one access point 15 which is present. In one advantageous embodiment, it is provided that the mixed beverage production appliance 7 is connected to a water connection outside the domestic appliance, so that a water supply line is possible, for example, via a mains domestic water supply. This has the additional advantage that a fluid added as water to the mixed beverage does not have to be stored in a large-sized container in the mixed beverage production appliance 7 but this container may be dimensioned to be smaller and refilled depending on requirements and according to the situation. It may also be provided that such a water supply for producing the mixed beverage is not provided from the tank and/or the container which is provided for receiving this fluid in the mixed beverage production appliance 7, but additionally or alternatively may also be passed directly from this line to the dispensing unit 20 and thus also to the outlet 21.

Thus, in particular during the production of hot drinks instead of a cold drink, the energy required for heating is reduced, since the initial temperature of the water is higher. If carbonation of the mixed beverage is desired, this may be implemented by mixing in carbonated cold water which is cooled in the mixed beverage production appliance 7 or made possible by a carbonated second fluid, which is then present in the second container.

It is provided, in particular, that the mixed beverage production appliance 7 has a first container in which a first fluid having a first freezing point, in particular water, is available and/or stored in order to prepare it as required for producing and dispensing a mixed beverage. The mixed beverage production appliance 7 also contains a second container which is separate therefrom and which is configured for receiving a second fluid which is different from the first fluid and which has a freezing point which is different from the first fluid. In particular, the first fluid is water and the second fluid is alcohol so that the mixed beverage may also be an alcoholic mixed beverage.

In one advantageous embodiment in which the mixed beverage production appliance 7 is configured not only for dispensing a cooled mixed beverage but also for dispensing a hot beverage, at least one heating unit is provided. This is preferably connected in the vicinity of the outlet 21 in order to minimize heat losses and to permit as little heat input as possible into the domestic refrigeration appliance 1. The heating unit may be in contact with the line of the outlet 21. This heating unit may preferably also constitute a component of the insulation of the capsule mechanism and thus the capsule receiver 22. In order to prevent heat input into the domestic refrigeration appliance 1 it is advantageous to attach thermal insulation to the additional heating unit on the dispensing unit 20. With corresponding heat insulation, for example by an aerogel, the heat is discharged mainly to the outside into the environment. Since the heating unit is only activated briefly, when a corresponding hot beverage is intended to be produced and dispensed, the heat conduction through the lines which lead outside is significantly higher than the heat conduction through the insulation to the inside. Additionally, it is advantageous if the insulation has a high thermal capacity or contains a thermal storage material, for example a phase change material. In such an embodiment the waste heat from the heating unit is preferably stored in the material, temperature peaks may be reduced and as a whole the heat input to the inside significantly reduced. This thermal store may be thermally connected to the externally visible surfaces of the dispensing unit 20. As a result, the temperature of these surfaces rises and possible condensation of humidity may be prevented.

It may also be provided that lines from outlets 21 in the dispensing unit 20, which are configured for dispensing one or more fluids, are provided with Peltier elements which permit active cooling or heating of the lines. If, after the dispensing of a hot beverage, a cold beverage is desired by a user, the situation arises that the lines of the dispensing unit 20 may still be warm. The cold water and/or the cold alcohol from the aforementioned containers is heated so that the finished cold beverage has a higher temperature than desired. This may be counteracted by the Peltier elements since, by means of the cooling, the lines always have the same temperature. Thus it is achieved that a cold beverage or a hot beverage has the temperature which is desired by the user, irrespective of the temperature of the previously dispensed beverage.

By the respectively adapted embodiment for cooling the capsules in the capsule store 23, the storage life of the capsules at low temperatures may also be extended.

Preferably, the capsule store 23 which is configured as a drawer, in particular, is also thermally insulated in the front region, for example by an expanded polystyrene (EPS) component or a polyurethane (PU) component or an aerogel component in order to reduce the thermal input. As a result, the front visible surface of the capsule store 23 may also be thermally insulated so that no undesired cold temperatures are present, which might be unpleasant for a user when handling and/or touching.

In one advantageous embodiment, it is provided that the mixed beverage production appliance 7 also has an ice cube production and dispensing unit and/or has an ice-slush production and dispensing unit.

Advantageously, it is provided that a seal is located on the rear face of a flange on the front face of the housing 9 and in the inserted state of the mixed beverage production appliance 7 separates the receiving region 8 from the environment.

Figure 2:
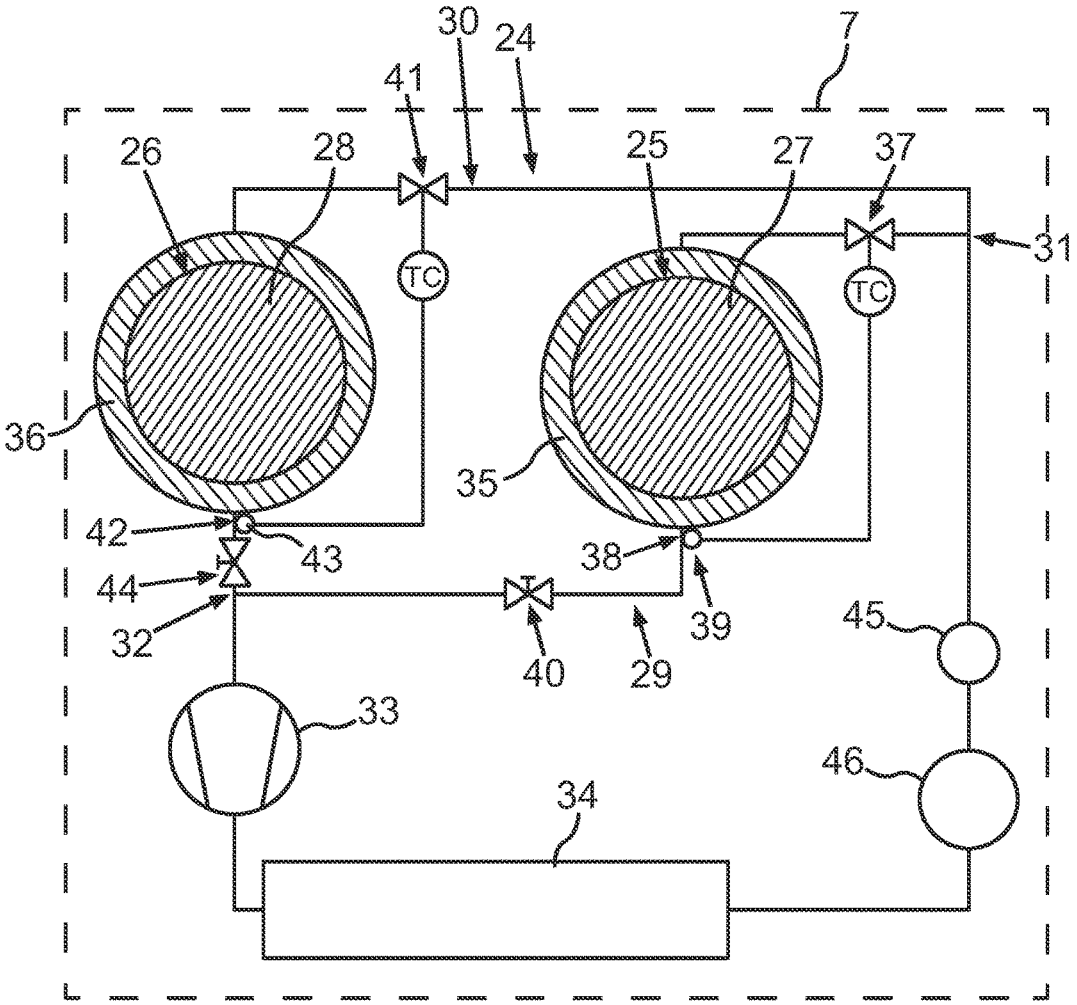
FIG. 2 is a circuit diagram of a refrigerating circuit with containers of an embodiment of a mixed beverage production appliance connected therein.

In FIG. 2 a schematic circuit diagram of a refrigerating circuit 24 is shown as is preferably configured and installed in the mixed beverage production appliance 7. The refrigerating circuit 24 is thus thermally connected to the first container 25 and the second container 26. The containers 24 and 25 are then connected to the dispensing unit 20. A first fluid having a first freezing point, in the exemplary embodiment water 27, is introduced into the first container 25. A second fluid 28, which is different from the first fluid 27 and has a freezing point which is different from the first fluid 27, is introduced into the second container 26. In this case, alcohol is introduced as the second fluid or an alcoholic fluid is introduced.

As may be seen, the two containers 25 and 26 are separated from one another and, in particular, also thermally insulated from one another. The refrigerating circuit 24 has a first partial circuit 29, the first container 25 being connected thereto and/or thermally coupled therein. Moreover, the refrigerating circuit 24 has a second partial circuit 30, the second container 26 being connected and/or thermally coupled therein. The two partial circuits 29 and 30 are connected in parallel into the refrigerating circuit 24. To this end, the first partial circuit 29 branches off at a first branching-off point 31, so that the partial circuits 29 and 30 branch off from one another at this branching-off point 31. On the other hand, the partial circuits 29 and 30 are combined together again at a second branching-off point 32, so that here the two branches and/or partial circuits 29 and 30 are combined together again and the parallel connection of the partial circuits 29 and 30 is formed.

The refrigerating circuit 24 also contains a further compressor unit and/or compressor 33 which, in particular, is a speed-controlled compressor. Moreover, a condenser 34 is also present.

As may also be seen, a first evaporator 35 is connected into the first partial circuit 29 the first evaporator preferably being thermally coupled directly to the first container 25. In particular, this first evaporator 35 at least partially encompasses the container 25 over the circumference. Moreover, it is provided that a second evaporator 36 is connected into the second partial circuit 30, the second evaporator being thermally coupled directly to the second container 26 and also, in particular, at least partially surrounding this second container over the circumference.

Moreover, a first valve, in particular a first thermally controlled expansion valve 37, is connected into the first partial circuit 29, the first valve being controlled in a temperature-dependent manner. To this end, it is provided that a temperature detection unit 39 is arranged at an outlet 38 of the first evaporator 35 formed in the direction of flow of the refrigerant in the first partial circuit 29. Thus the thermally-controlled expansion valve 37, which is arranged in the direction of flow of the refrigerant upstream of the first evaporator 35 in the first partial circuit 29, is controlled according to this temperature. Moreover, it is preferably provided that a further valve 40 is arranged in the first partial circuit 29 and namely downstream of the evaporator 35 in the direction of flow of the refrigerant in this first partial circuit 29.

Advantageously, it is provided that a first valve, in particular a thermally-controlled expansion valve 41, is also connected into the second partial circuit 30. It is also provided here, in particular, that a temperature detection element 43 is arranged at an outlet 42 of the second evaporator 36 provided in the direction of flow of the refrigerant in the second partial circuit 30. Moreover, it is also provided here that a second valve 44 is connected into the second partial circuit 30, the second valve being arranged downstream of the second evaporator 36 in the direction of flow of the refrigerant. The valves may be stop valves or non-return valves. In particular, a second valve, in particular the second valve 40, is a stop valve.

Moreover, it is provided that in an advantageous embodiment of the invention a so-called drier 45 is contained in the refrigerating circuit 24, by which the residual moisture contained in the refrigerating circuit may be prevented. Moreover, a collection unit 46 is also connected into the refrigerating circuit 24, by which refrigerant may be collected and thus a certain amount of the excess refrigerant may be made available and provided if required.

By means of the embodiment of the refrigerating circuit 24, the two containers 25 and 26 may be subjected to different temperatures independently of one another so that the fluids 27, 28 located therein may be differently temperature-controlled independently of one another.

In particular, it is provided that the refrigerating circuit 24 is configured such that the temperature of the first container 25 is between 0.8° C. and 8° C., in particular between 0.8° C. and 1.5° C., and thus the first fluid 27 is also correspondingly temperature-controlled. In particular, it is provided that the refrigerating circuit 24 is configured such that the temperature of the second container 26 is between −8° C. and −20° C., in particular between −13° C. and −17° C., preferably −15° C. and thus the second fluid 28 is also correspondingly temperature-controlled.

In particular, further embodiments may also be provided in which the first container 25 and/or the second container 26 contain at least one active intermixing element and/or at least one passive intermixing element for intermixing the respective fluids 27 and 28, so that a uniform temperature distribution is present.

The mixed beverage production appliance 7 preferably also has a control unit, the dispensing of the first fluid 27 from the first container 25 and/or the dispensing of the second fluid 28 from the second container 26 being controlled thereby depending on an input by a user on an input unit. As a result, the mixed beverage may be metered in an accurate manner, in particular in terms of quantity. However, a quantity of at least one of the fluids which is specific to the user may be dispensed for a mixed beverage, for example when a user presses for a sufficiently long time on a dispensing control element of the input unit until the desired quantity of fluid has been dispensed.

The following is a summary list of reference numerals and the corresponding structure used in the above description of the invention:

1 Domestic refrigeration appliance
2 Housing
3 Inner container
4 First receiver space
5 Inner container
6 Second receiver space
7 Mixed beverage production appliance
8 Receiving region
9 Housing
10 Displacement device
11 Rail
12 Rail
13 Rail
14 Side wall
15 Access
16 Flap
17 Side wall
18 Top wall
19 Positioning recess
20 Dispensing unit
21 Outlet
22 Capsule receiver
23 Capsule store
24 Refrigerating circuit
25 First container
26 Second container
27 Water
28 Second fluid
29 First partial circuit
30 Second partial circuit
31 First branching-off point
32 Second branching-off point
33 Compressor
34 Condenser
35 First evaporator
36 Second evaporator
37 Expansion valve
38 Outlet
39 Temperature detection unit
40 Valve
41 Expansion valve
42 Outlet
43 Temperature detection element
44 Valve
45 Drier
46 Collection unit

The invention claimed is:

1. A mixed beverage production appliance, comprising:

a first container configured for receiving a first fluid having a first freezing point and being able to be added to a mixed beverage by the mixed beverage production appliance;

at least one second container being separate from said first container and configured for receiving a second fluid having a second freezing point which is different from the first freezing point and which is able to be added to the mixed beverage by the mixed beverage production appliance; and a refrigerating circuit, said first and second containers being connected into said refrigerating circuit being configured such that said first and second two containers are able to be subjected to different temperatures independently of one another, said refrigerating circuit having a first partial circuit and a second partial circuit connected in parallel to said first partial circuit, said first container being connected in said first partial circuit and said second container being connected in said second partial circuit.

2. The mixed beverage production appliance according to claim 1, wherein said refrigerating circuit is configured such that a temperature of said first container is between 0.8° C. and 8° C.

3. The mixed beverage production appliance according to claim 1, wherein said refrigerating circuit is configured such that a temperature of said second container is between −8° C. and −20° C.

4. The mixed beverage production appliance according to claim 1, further comprising a first evaporator connected into said first partial circuit.

5. The mixed beverage production appliance according to claim 4, further comprising a first valve connected into said first partial circuit upstream of said first evaporator in a direction of flow of a refrigerant in said first partial circuit.

6. The mixed beverage production appliance according to claim 5, wherein said first valve is a thermally-controlled expansion valve; and further comprising a thermometer disposed adjacent to said first evaporator for detecting a temperature and said thermally-controlled expansion valve being able to be operated dependent on the temperature.

7. The mixed beverage production appliance according to claim 5, further comprising a second valve connected into said first partial circuit downstream of said first evaporator in the direction of flow of the refrigerant in said first partial circuit.

8. The mixed beverage production appliance according to claim 5, wherein said first valve is a thermally-controlled expansion valve.

9. The mixed beverage production appliance according to claim 4, further comprising a second evaporator connected into said second partial circuit.

10. The mixed beverage production appliance according to claim 9, further comprising a third valve connected into said second partial circuit upstream of said second evaporator in a direction of flow of a refrigerant in said second partial circuit.

11. The mixed beverage production appliance according to claim 10, wherein said third valve is a thermally controlled expansion valve; and further comprising a thermometer disposed adjacent to said second evaporator for detecting a temperature and said thermally controlled expansion valve being able to be operated dependent on the temperature.

12. The mixed beverage production appliance according to claim 11, wherein said second evaporator has an outlet, said thermometer is disposed adjacent to said outlet of said second evaporator viewed in the direction of flow of the refrigerant in said second partial circuit.

13. The mixed beverage production appliance according to claim 10, further comprising a fourth valve connected into said second partial circuit downstream of said second evaporator in the direction of flow of a refrigerant in said second partial circuit.

14. The mixed beverage production appliance according to claim 10, wherein said third valve is a thermally-controlled expansion valve.

15. The mixed beverage production appliance according to claim 9, wherein said second evaporator is thermally connected directly to said second container and at least partially encompasses said second container.

16. The mixed beverage production appliance according to claim 4, wherein said first evaporator is thermally connected directly to said first container and at least partially encompasses said first container.

17. A domestic refrigeration appliance, comprising:

a housing;

a receiver space for foodstuffs being configured in said housing;

a mixed beverage production appliance, containing:

a first container configured for receiving a first fluid having a first freezing point and being able to be added to a mixed beverage by said mixed beverage production appliance;

at least one second container being separate from said first container and configured for receiving a second fluid having a second freezing point which is different from the first freezing point and which is able to be added to said mixed beverage by said mixed beverage production appliance; and a refrigerating circuit, said first and second containers being connected into said refrigerating circuit being configured such that said first and second two containers are able to be subjected to different temperatures independently of one another, said refrigerating circuit having a first partial circuit and a second partial circuit connected in parallel to said first partial circuit, said first container being connected in said first partial circuit and said second container being connected in said second partial circuit.

18. A method for temperature control of components of a mixed beverage production appliance configured for producing and dispensing a beverage, the mixed beverage production appliance containing a first container configured for receiving a first fluid having a first freezing point and being able to be added to a mixed beverage by the mixed beverage production appliance, at least one second container being separate from the first container and configured for receiving a second fluid having a second freezing point which is different from the first freezing point and which is able to be added to the mixed beverage by the mixed beverage production appliance and a refrigerating circuit, the first and second containers being connected into the refrigerating circuit being configured such that the first and second containers are able to be subjected to different temperatures independently of one another, which comprises the steps of:

subjecting the first container to a temperature such that the first fluid present in the first container is set to a temperature above the first freezing point; and subjecting the second container to a temperature such that the second fluid present in the second container is set to a different temperature from the temperature of the first fluid and above the second freezing point.

* * * * *